United States Patent [19]

Tamano et al.

[11] 3,932,723

[45] Jan. 13, 1976

[54] ELECTRONIC RANGE WITH AUTOMATIC ELECTRONIC DIGITAL TIMER

[75] Inventors: Motokazu Tamano, Yokohama; Tomimitsu Noda; Masanobu Yoshioka, both of Fuji, all of Japan

[73] Assignee: Tokyo Shibaura Electric Co., Ltd., Kawasaki, Japan

[22] Filed: Apr. 17, 1974

[21] Appl. No.: 461,748

[30] Foreign Application Priority Data

Apr. 20, 1973 Japan ..... 48-44833

[52] U.S. Cl. ..... 219/10.55 B; 58/39.5; 58/21.13; 99/325; 219/10.55 M

[51] Int. Cl.[2] ..... H05B 9/06

[58] Field of Search... 219/10.55 B, 10.55 R, 10.55 M; 58/33, 39.5, 21.13, 50 R; 340/366 G; 99/325; 126/197

[56] References Cited

UNITED STATES PATENTS

| | | | |
|---|---|---|---|
| 3,182,166 | 5/1965 | Bohm et al. | 219/10.55 M |
| 3,445,784 | 5/1969 | Staats et al. | 219/10.55 B |
| 3,610,753 | 10/1971 | Neubauer | 58/39.5 |
| 3,646,751 | 3/1972 | Purland et al. | 58/50 R |
| 3,686,880 | 8/1972 | Samejima | 58/39.5 |
| 3,757,509 | 9/1973 | Fujita | 58/39.5 |
| 3,765,163 | 10/1973 | Lerine | 58/50 R |
| 3,819,112 | 6/1974 | Goodhouse | 99/325 |

*Primary Examiner*—Bruce A. Reynolds
*Attorney, Agent, or Firm*—Oblon, Fisher, Spivak, McClelland & Maier

[57] ABSTRACT

An electronic range wherein a digital value showing the quantity of food being cooked is set and indicated by a food quantity-setting device; another device is provided to select the kind of food being cooked; the period of pulses generated by a pulse generator is determined by an output from said selection device; pulses emitted by the pulse generator are counted upon commencement of a food-heating operation; the counts made by the counter are indicated in the form of digits; and heating by the electronic range is brought to an end when a prescribed relationship arises between the counts made by the counter and the previously set value denoting the quantity of food.

8 Claims, 18 Drawing Figures

| | |
|---|---|
| FIG. 1A | FIG. 1C |
| FIG. 1B | FIG. 1D |

FIG. 8
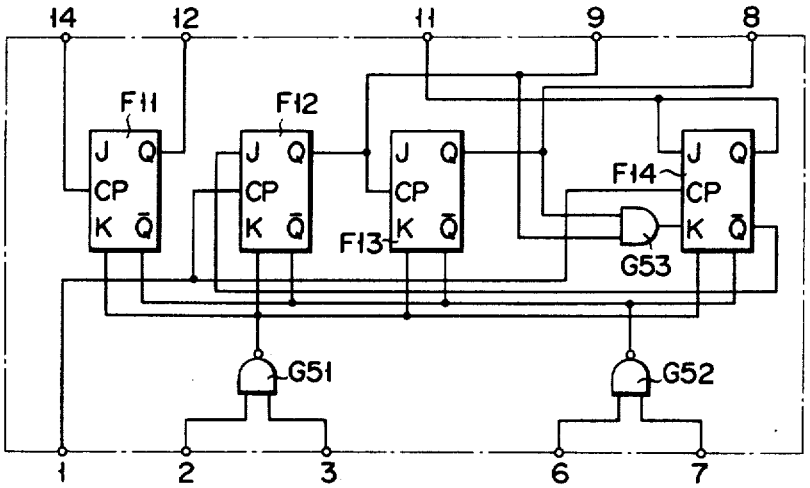
FIG. 9
| COUNT | OUTPUT | | | |
|---|---|---|---|---|
| | A | B | C | D |
| 0 | 0 | 0 | 0 | 0 |
| 1 | 1 | 0 | 0 | 0 |
| 2 | 0 | 1 | 0 | 0 |
| 3 | 1 | 1 | 0 | 0 |
| 4 | 0 | 0 | 1 | 0 |
| 5 | 1 | 0 | 1 | 0 |
| 6 | 0 | 1 | 1 | 0 |
| 7 | 1 | 1 | 1 | 0 |
| 8 | 0 | 0 | 0 | 1 |
| 9 | 1 | 0 | 0 | 1 |
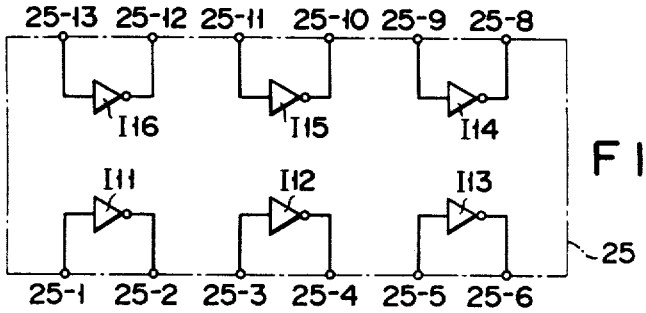
FIG. 10

ELECTRONIC RANGE WITH AUTOMATIC ELECTRONIC DIGITAL TIMER

BACKGROUND OF THE INVENTION

This invention relates to an electronic range provided with an electronic digital timer capable of automatically setting the time of heating according to the quantity and kind of food being cooked.

A general electronic range sets a time of cooking food by a timer. In this case, heating time is set by searching for an optimum length of cooking time for the quantity and kind of food being cooked or by the experience or sense of a person undertaking cooking. Accordingly, the time of cooking the same quantity and kind of food varies from person to person using an electronic range, resulting in a failure to carry out proper cooking.

The prior art timer generally consists of a motor timer formed of a combination of a synchronous motor and gear mechanism or a mechanical timer such as a spring type. The mechanical timer requires the timer needle to be manually rotated whenever cooking time is set, leading to a very much complicated operation. Since indication by the timer is always made solely by means of the needle, an actual lapse of time since the commencement of heating can not be found, if the needle is fixed at a point of said set time. Conversely where the needle is made to move as time goes on, then it is impossible to trace an originally set time, giving rise to the erroneous observation of time indication on the panel of the timer or the incorrect setting of cooking time. These errors have often caused the misunderstanding of the initially set time or the wide displacement of a set time from a desired value, resulting in insufficient cooking. Moreover, the mechanical timer is relatively bulky and subject to failure.

It is accordingly the object of this invention to provide an electronic range provided with a compact electronic digital timer which can automatically set a proper time of cooking or heating for the quantity and kind of food being cooked and, where required, indicate an originally set time as well as a lapse of time from the initial point of cooking time set in the form of digits.

SUMMARY OF THE INVENTION

According to this invention there is provided an electronic range fitted with a high frequency generator which comprises a device for setting a value representing the quantity of food being cooked; a device for indicating said set value in the form of digits; a pulse generator; a device for varying the period of pulses generated by said pulse generator according to the quantity and kind of food being cooked; a counter for counting pulses from the pulse generator upon the commencement of a food-heating operation; and a device for bringing the operation of the high frequency generator to an end when a prescribed relationship arises between the counts made by the counter and a value denoting an originally set time.

BRIEF DESCRIPTION OF THE DRAWINGS

FIG. 8 is a circuit diagram of a counter used in FIGS. 2A to 2D;

FIG. 9 is a truth table showing the relationship between the binary code counts made by the counter of FIG. 8 and the decimal numerals;

FIG. 10 shows the arrangement of an integrated circuit used as an inverter in FIGS. 2A to 2D;

DETAILED DESCRIPTION OF THE INVENTION

Figure 1:
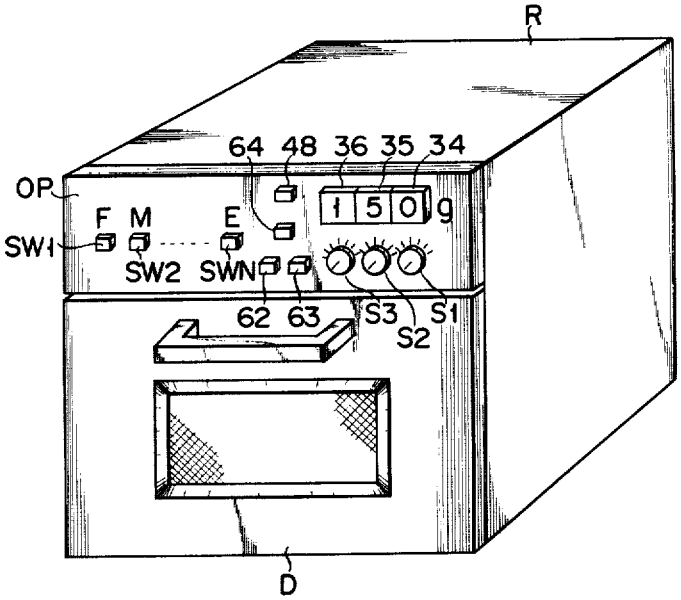
FIG. 1 is an oblique view of the outward appearance of an electronic range according to an embodiment of this invention.

Referring to FIG. 1, the body R of an electronic range is provided at the front with a door D and operation panel OP. This operation panel OP is fitted with food-quantity setting switches S1, S2, S3, which cause display devices 34, 35, 36 collectively indicate a decimal numeral, for example, 150 when the quantity of food being cooked is separately measured to be 150g. The push-button switches SW1, SW2, ..... SWN are depressed according to the kind of food being cooked. For example, the switch SW1 represents fish (F), the switch SW2 meat (M) and the switch SWN an egg (E). The operation panel OP is further provided with a power supply switch 48, cooking start switch 62, cooking stop switch 63 and reset switch 64.

Referring to FIGS. 2A to 2D, the food quantity-setting section comprises food-quantity setting switches S1, S2, S3 and gate circuits 1, 2, 3, 4, 5, 6, 7, 8 for converting decimal data from the switches S1, S2, S3 into binary data coded with a weight of 1–2–4–8. The term "quantity of food", as used herein, is defined to mean, for example, the number of pieces of food being cooked, the number of persons served with said food and the overall weight (in gram) thereof. For convenience, the following description is given only with reference to the total weight of food being cooked at each time of heating.

Figure 2A:
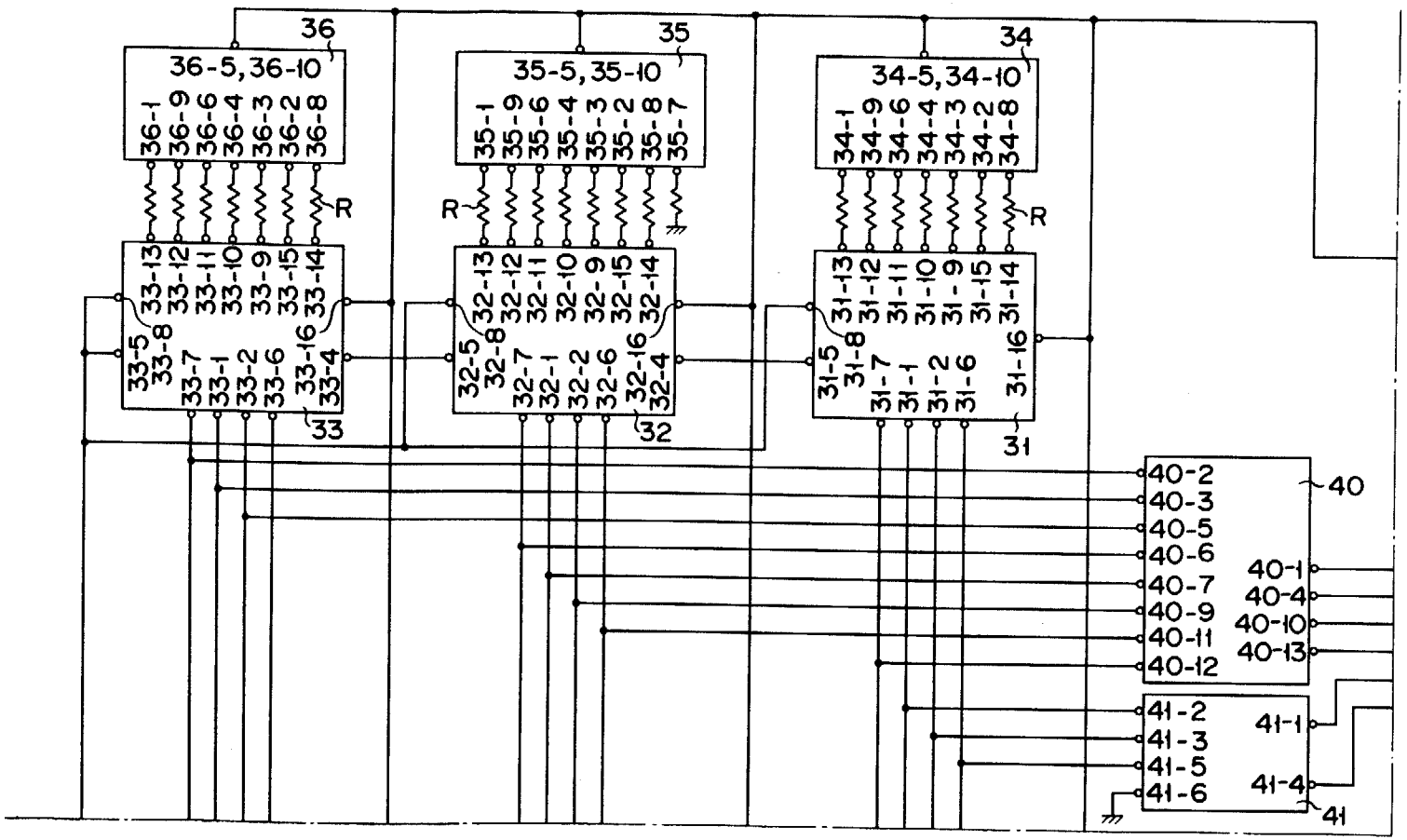
FIGS. 2A to 2D are circuit diagrams of said embodiment.
Figure 2B:
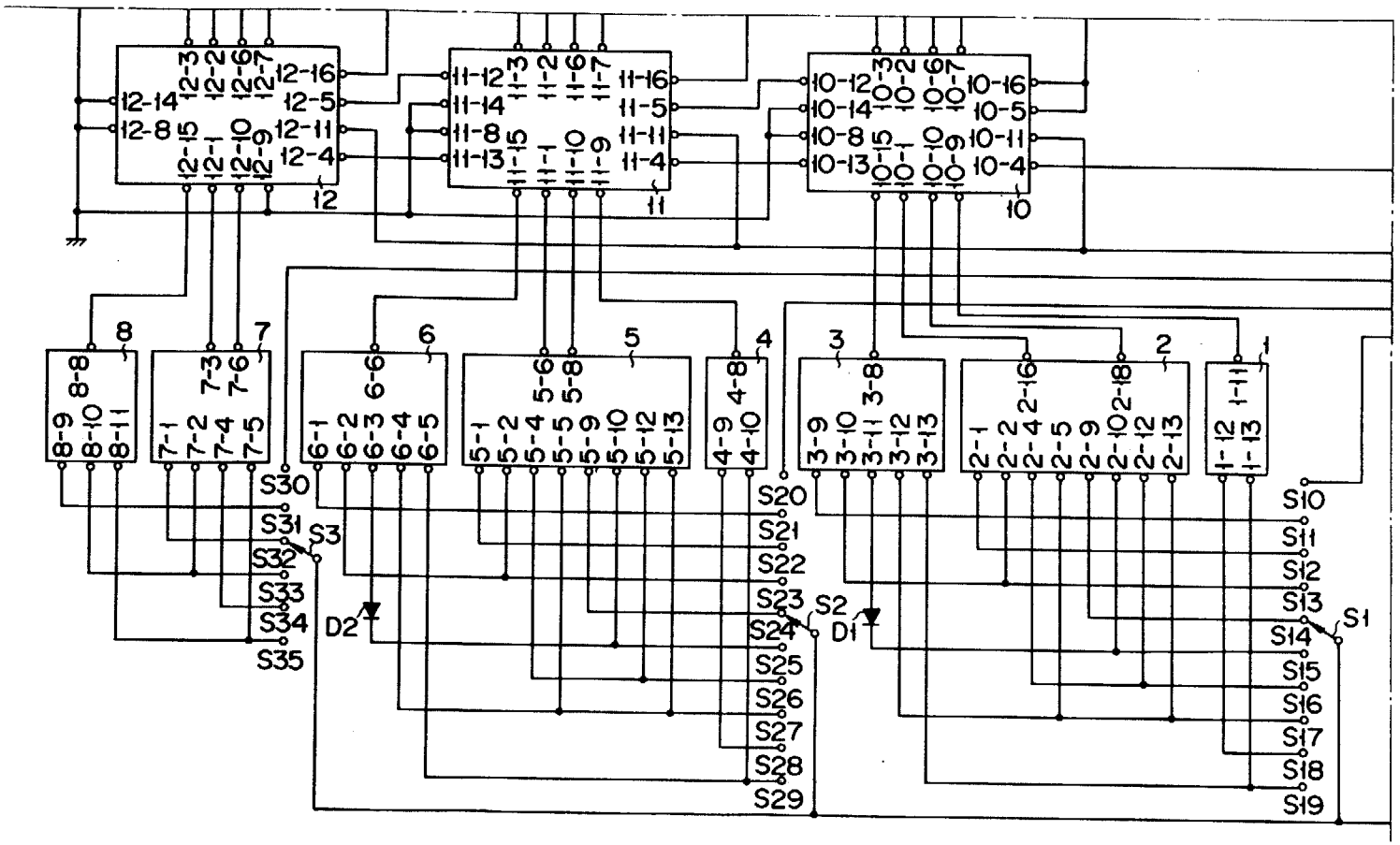
Figures 2C, 3:
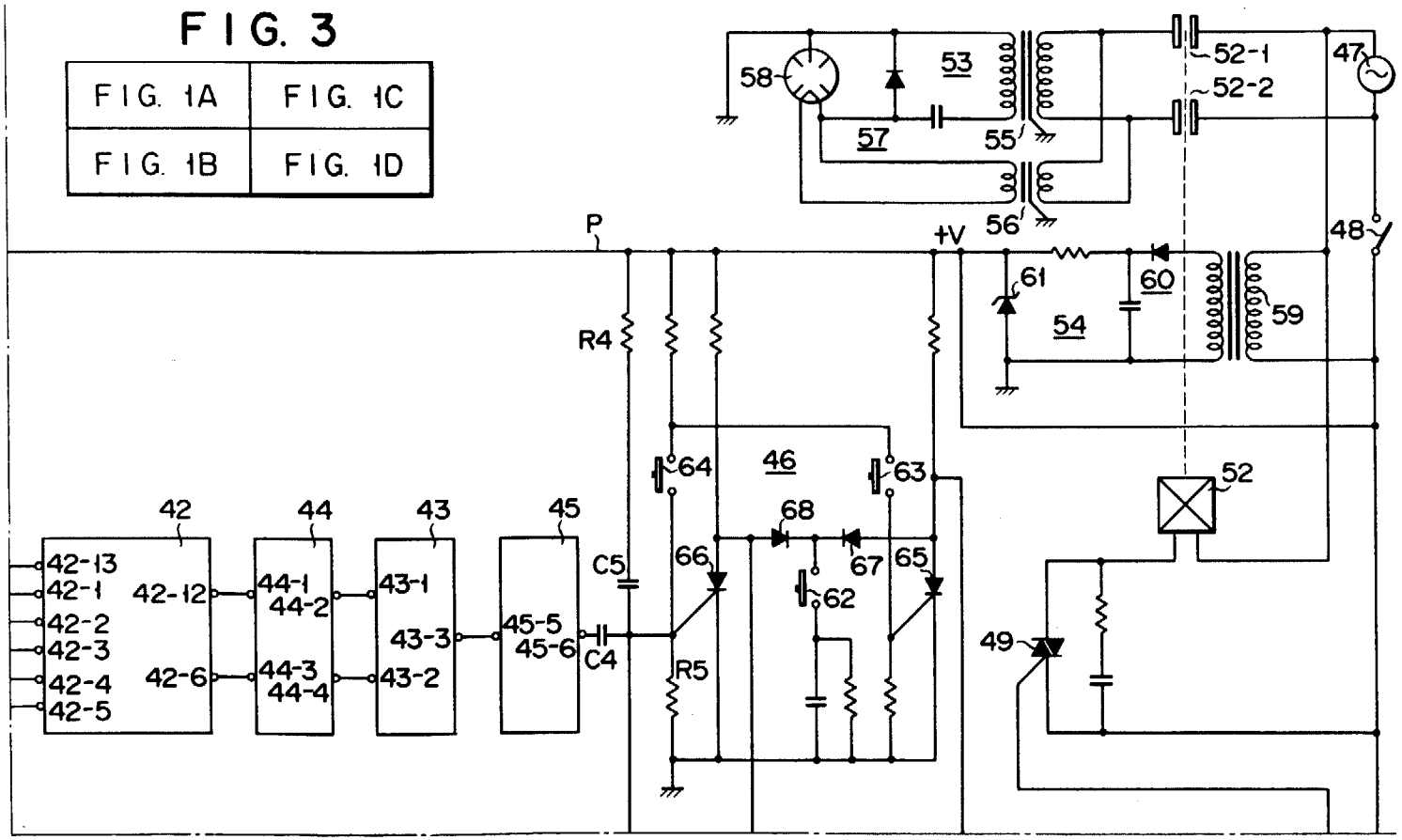
FIG. 3 presents the relative positions of the sections of FIGS. 2A to 2D.
Figure 2D:
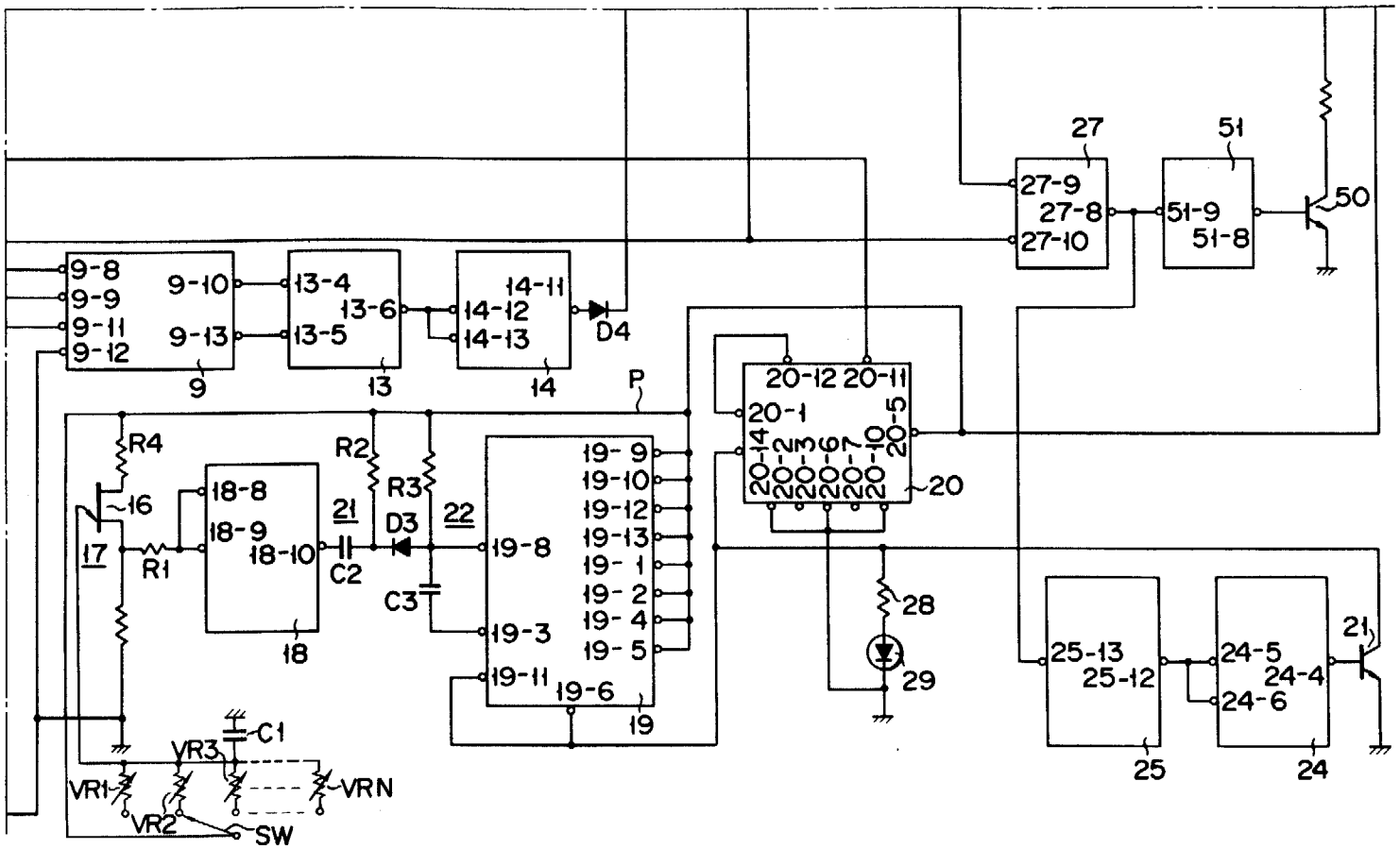

The food-quantity setting switches S1, S2, S3 of FIGS. 2B, 2D are provided with fixed contacts S10 to S19, S20 to S29, S30 to S35 for setting cooking time in the form of decimal numerals corresponding to units of 1g, units of 10g and units of 100g respectively. Therefore, these three food-quantity setting switches S1, S2, S3 can be used to set a decimal numeral representing the quantity of food weighing, from zero to 599 grams in units of 1 gram.

The movalbe contacts of said switches S1, S2, S3 are grounded. The fixed contacts S10 to S19 are connected to a decimal numeral-binary code conversion circuit consisting of three gate circuits 1, 2, 3. The fixed contacts S20 to S29 are connected to a decimal numeral-binary code conversion circuit formed of three gate circuits 4, 5, 6. The fixed contacts S30 to S35 are connected to a decimal numeral-binary code conversion circuit consisting of two gate circuits 7, 8. These three conversion circuits generate a 4-bit binary signal coded with a weight of 1–2–4–8 and a 3-bit binary signal coded with a weight of 12-4. The fixed contact S10 of the quantity (weight)-setting switch S1 is connected to the terminal 9-111 of a gate circuit 9. The terminals 1-12, 1-13 of the gate circuit 1 are connected to contacts S18, S19; the terminals 2-1, 2-2, 2-4, 2-5, 2-9, 2-10, 2-12, 2-13 of the gate circuit 2 to contacts S12, S13, S16, S17, S13, S15, S16, S17; the terminals 3-9, 3-10, 3-12, 3-13 of the gate circuit 3 to contacts S11, S13, S17, S19; and the terminal 3-11 of gate circuit 3 to a contact S15 through a diode D1. The contact S20 of the quantity-setting switch S2 is connected to the terminal 9-9 of the safe circuit 9.

Figure 4:
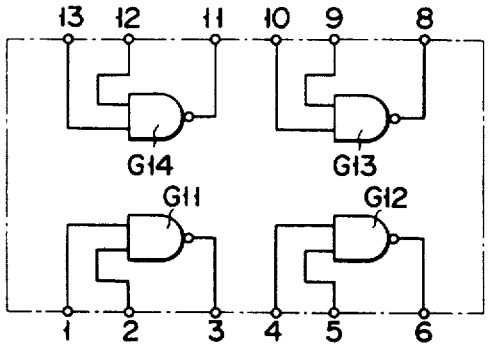
FIGS. 4 to 7 show integrated circuit arrangements used as gate circuits in the sections of FIGS. 2A to 2D.

The terminals 4-9, 4-10 of the gate circuit 4 are connected to contacts S27, S28; the terminals 5-1, 5-2, 5-4, 5-5, 5-9, 5-10, 5-12, 5-13 of the gate circuit 5 to contacts S22, S23, S24, S25, S26, S27; the terminals 6-1, 6-2, 6-4, 6-5 of the gate circuit 6 to contacts S21, S23, S27, S29; the terminal 6-3 of the gate circuit 6 to the contact S25 through a diode D2; the contact S30 of the weight-setting switch S3 to the terminal 9-8 of the gate circuit 9; the terminals 7-1, 7-2, 7-4, 7-5 of the gate circuit 7 to contacts S32, S33, S34, S35; and the terminals 8-9, 8-10, 8-11 of the gate circuit 8 to contacts S31, S33, S35. The contacts S10-S19 of the quantity-setting switch S1 are associated with 0, 1, 2, . . . . . 9 grams. The output terminals 1-11, 2-16, 2-18 and 3-8 of the gate circuits 1, 2 and 3 generate 4-bit binary signals coded with a weight of 1–2–4–8. These 4-bit binary signals are supplied to the input terminals 10-9, 10-10, 10-1, 10-15 of a gate circuit 10 of the counter section. The contacts S20-S29 of the quantity-setting switch S2 are associated with 0, 10, 20, . . . . . 90 grams, and produce 4-bit binary signals coded with a weight of 1–2–4–8. These 4-bit binary signals are conducted to the input terminals 11-9, 11-10, 11-1, 11-15 of a gate circuit 11 of the counter section. The contacts S30 to S35 of the quantity-setting switch S3 are used to indicate 0, 100, 200, 300, 400 and 500 grams. The output terminals 7-3, 7-6 and 8-8 of the gate circuits 7 and 8 give forth 3-bit binary signals coded with a weight of 1–2–4. These 3-bit binary signals are transmitted to the input terminals 12-1, 12-10, 12-15 of a gate circuit 12 of the counter section. The gate circuits 1, 2, 4, 5, 7 are actually integrated as shown in FIG. 4. The referential numerals of the terminals of the respective gate circuits of FIG. 4 correspond to those following the hyphens included in the referential notations indicated in FIG. 2B. For example, the terminal 12 of FIG. 4 corresponds to the terminals 1-12, 2-12, 5-12 of the gate circuits 1, 2, 5. The gate circuits 1, 2, 4, 5, 7 are each provided with four NAND gate circuits G11, G12, G13, G14 as shown in FIG. 4. Two input terminals of the NAND gate circuit G11 are connected to the terminals 1, 2 and the output terminal thereof to the terminal 3. The input terminals of the NAND gate circuit G12 are connected to the terminals 4, 5 and the output terminal thereof to the terminal 6. The input terminals of the NAND gate circuit G13 are connected to the terminals 9, 10 and the output terminal thereof to the terminal 8. The input terminals of the NAND gate circuit G14 are connected to the terminals 12, 13 and the output terminal thereof to the terminal 11.

Figure 5:
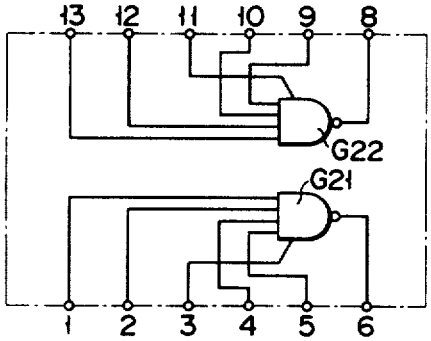

The gate circuits 3, 6 are concretely integrated as shown in FIG. 5. The referential numerals of the integrated circuit of FIG. 5 correspond to those following the hyphens included in the referential notations of the gate circuits 3, 6 of FIG. 2B. Namely, the terminal 13 of FIG. 5 corresponds to, for example, the terminal 3-13 of the gate circuit 3 of FIG. 2B. The gate circuits 3, 6 respectively consist of a NAND/NOR buffer gate circuit G21 provided with an expander terminal 3 and another NAND/NOR buffer gate circuit G22 provided with an expander terminal 10. The input terminals of the NAND/NOR buffer gate circuit G21 are connected to the terminals 1, 2, 4, 5 and the output terminal thereof to the terminal 6. The input terminals of the NAND/NOR buffer gate circuit G22 are connected to the terminals 9, 10, 12, 13 and the output terminal thereof to the terminal 8.

Figure 6:
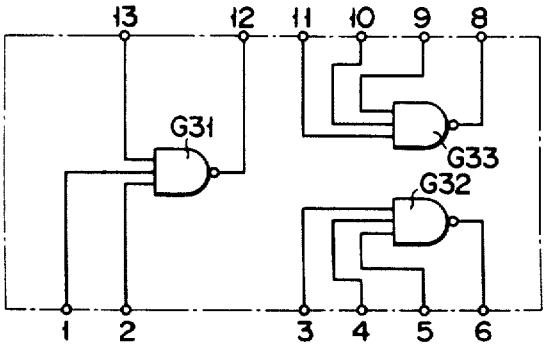

There will now be described by reference to FIG. 6 the integrated concrete arrangement of the gate circuit 8. This gate circuit 8 is formed of three NAND/NOR gate circuits G31, G32, G33. The input terminals of the NAND/NOR gate circuit G31 are connected to the terminals 1, 2, 13 and the output terminal thereof to the terminal 12. The input terminals of the NAND/-NOR gate circuit G32 are connected to the terminals 3, 4, 5 and the output terminal thereof to the terminal 6. The input terminals of the NAND/NOR gate circuit G33 are connected to the terminals 9, 10, 11 and the output terminal thereof to the terminal 8.

A gate circuit 9 connected to the contacts S10, S20, S30 of the quantity-setting switches S1, S2, S3 respectively and gate circuits 13, 14 connected to the gate circuit 9 jointly act as a circuit for stopping the operation of the electronic digital timer and that of the later described electronic range controlling section, where the time of cooking is set at zero, namely where all the quantity-setting switches S1, S2, S3 are connected to the contacts S10, S20, S30 respectively.

Figure 7:
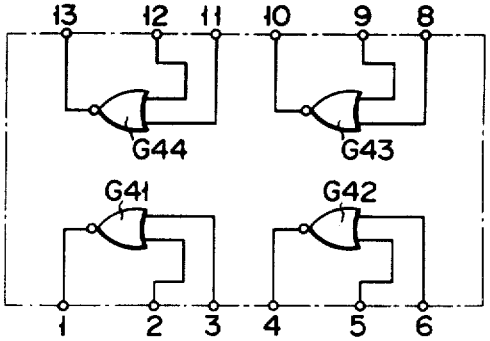

The terminals 9-10, 9-13 of the gate circuit 9 are connected to the terminals 13-4, 13-5 of a gate circuit 13 and the output terminal 13-6 of a gate circuit 13 is connected to both input terminals 14-12, 14-13 of a gate circuit 14. The gate circuit 9 is formed in an integrated circuit consisting of four NOR gate circuits G41, G42, G43, G44 as shown in FIG. 7. The input terminals of the NOR gate circuit G41 are connected to the terminals 2, 3 and the output terminal thereof to the terminal 1. The input terminals of the NOR gate circuit G42 are connected to the terminals 5, 6 and the output terminal thereof to the terminal 4. The input terminals of the NOR gate circuit G43 are connected to the terminals 8, 9 and the output terminal thereof to the terminal 10. The input terminals of the NOR gate circuit G44 are connected to the terminals 11, 12 and the output terminal thereof to the terminal 13. Gate circuits 13, 14 have the same arrangement as shown in FIG. 4.

A pulse generating section has a circuit arrangement as indicated in FIG. 2D. This pulse-generating section includes a time constant circuit having variable resistors VR1, VR2 . . . . . VRN, and capacitor C1, a turnover switch SW and a pulse oscillator 17 formed of a unijunction transistor 16 and gives forth pulses at a prescribed interval. An output from the pulse generator 17 is supplied to the terminals 18-8, 18-9 of a gate circuit 18 through a resistor R1. A terminal 18-10 is connected to one end of a resistor R2 and the cathode of a diode D3 through a capacitor C2. The anode of the diode D3 is connected to one end of a resistor R3, one end of a capacitor C3 and the terminal 19-8 of a gate circuit 19. The other end of the capacitor C3 is connected to a terminal 19-3 and terminals 19-6, 19-11 are connected to the terminal 20-14 of a decimal decoder counter 20 and the collector of a transistor 21. The movable contact of the switch SW, one end each of resistors R4, R2, R3, the terminals 19-1, 19-2, 19-4, 19-5, 19-9, 19-10, 19-12, 19-13 of the gate circuit 19 are connected to a positive line P of a D.C. source. The gate circuit 18, resistor R2 and capacitor C2 jointly act as a trigger circuit 21, an output from which is supplied to a monostable multivibrator 22 consisting of the resistor R3, capacitor C3 and gate circuit 19 through the diode D3 so as to trigger said multivibrator 22. An output pulse from the pulse generator 17 whose wave form has been shaped by the monostable multivibrator 22 is delivered to the decoder counter 20. The gate circuit 18 is arranged as shown in FIG. 7 and the gate circuit 19 is arranged as shown in FIG. 5. The decoder counter 20 comprises, as indicated in FIG. 8, four J–K flip-flop circuits F11, F12, F13, F14 and NAND/NOR gates G51, G52 and an AND gate G53. The input terminal 1 of the decoder counter of FIG. 8 is connected to the clock pulse input terminals of the J–K flip-flop circuits F12, F14. The reset signal input terminals 2, 3 of the decoder counter 20 of FIG. 8 are connected to the input terminal of an NAND/NOR gate G51. The reset signal input terminals 6, 7 of the counter 20 are connected to the input terminal of the NAND/NOR gate G52. The output terminals of the NAND/NOR gates G51, G52 are connected to the reset terminals of the J–K flip-flop circuits F11-F14 respectively. The clock pulse input terminal Cp of the J–K flip-flop circuit F11 is connected to the input terminal 14 of the decoder counter 20. The Q output terminal of the J–K flip-flop circuit F11 is connected to the output terminal 12 of the decoder counter 20. The J input terminal of the J–K flip-flop circuit F12 is supplied with a $\overline{Q}$ output from the J–K flip-flop circuit F14. A Q output from the J–K flip-flop circuit F12 is supplied to the Cp terminal of the flip-flop circuit F13, one input terminal of an AND gate G53 and the output terminal 9 of the decoder counter 20. A Q output from the J–K flip-flop circuit F13 is conducted to the other input terminal of the AND gate G53 and the output terminal 8 of the decoder counter 20. The J input terminal of the J–K flip-flop circuit F14 is connected to the Q output terminal thereof and the output terminal 11 of the decoder counter 20. The K input terminal of the J–K flip-flop circuit F14 is connected to the output terminal of the AND gate G53. Referring to FIG. 2D, the terminal 20-1 of the decoder counter 20 is connected to the terminal 20-12, and the terminals 20-2, 20-6, 20-10 of the decoder counter 20 are jointly grounded. The terminal 20-5 is connected to the positive line P of the power source, and the terminal 20-11 to the terminal 10-4 of the gate circuit 10.

The decoder counter 20 is supplied at the terminal 20-14 with outputs from the terminals 19-6, 19-11 of the gate circuit 19 and gives forth a count output in the form of a 4-bit binary code signal. FIG. 9 shows the truth table of binary code signals relating to the decimal numerals of 0 to 9 delivered from the terminals 20-12, 20-9, 20-8, 20-11.

The base of an NPN transistor 21 connected to the pulse-generating section is connected to the output terminal 24-8 of a gate circuit 24. The input terminals 24-5, 24-6 of the gate circuit 24 are jointly connected to the output terminal 25-12 of an inverter circuit 25, whose input terminal 25-13 is so connected as to receive an operation signal from the output terminal 27-8 of a gate circuit 27 of the later described operation circuit 46. The output terminals 19-6, 19-11 of the gate circuit 19 of the pulse-generating section are connected to the decoder counter 20 through the NPN transistor 21 which is turned on or off according to an output from the operation circuit 46 or otherwise grounded. The gate circuit 24 consists of an integrated circuit shown in FIG. 7, and the inverter circuit 25 is formed of an integrated circuit indicated in FIG. 10. Referring to FIG. 10, the input terminals of six inverter circuits I11, I12, I13, I14, I15, I16 are connected to the terminals 25-1, 25-3, 25-5, 25-9, 25-11, 25-13. The output terminals of the six inverter circuits are connected to the terminals 25-2, 25-4, 25-6, 25-8, 25-10, 25-12. The inverter I16 included in the integrated circuit of FIG. 10 is used in FIG. 2D.

The output terminals 19-6, 19-11 of the gate circuit 19 are grounded through a resistor 28 and light-emitting diode 29. This light-emitting diode 29 intermittently gives forth light in synchronization with pulses delivered from the pulse-generating section, thereby indicating the operating condition of the pulse-generating section.

Figure 11:
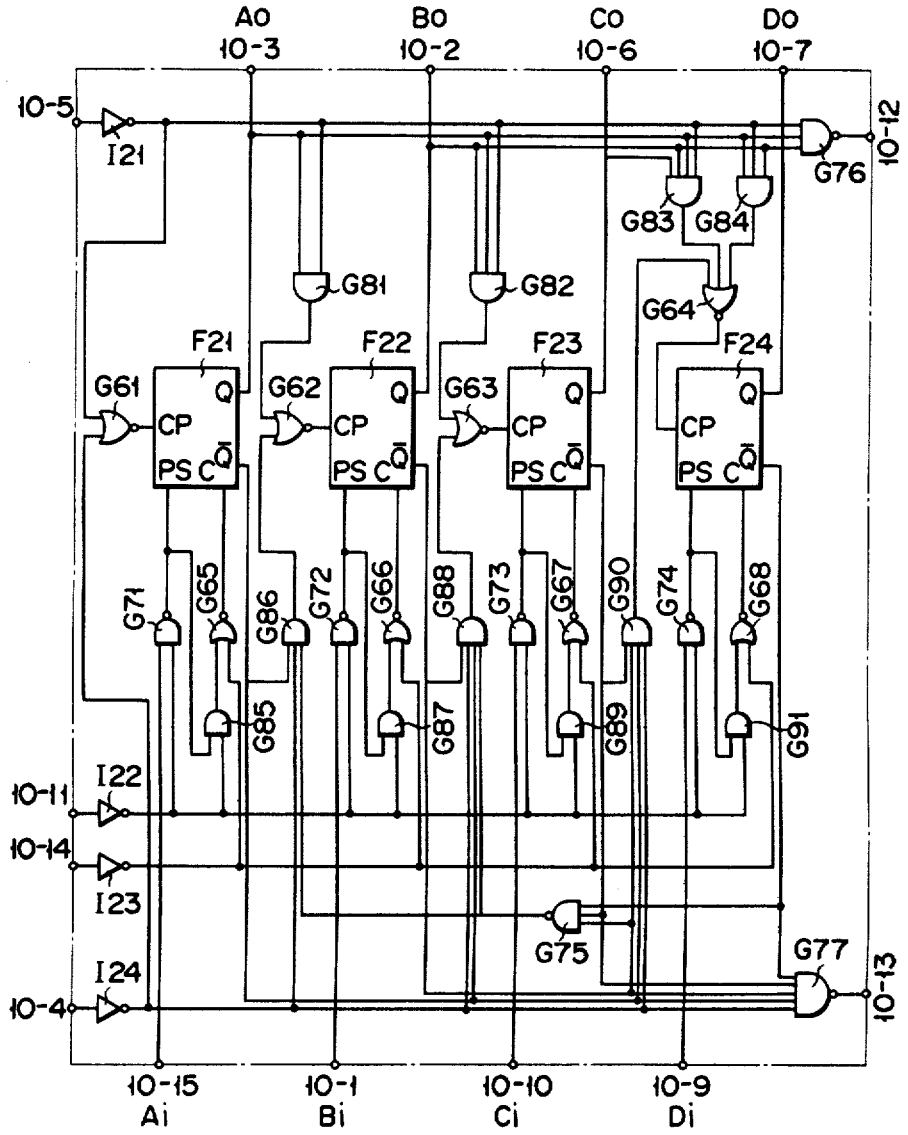
FIG. 11 is a circuit diagram of an up-down counter used in FIGS. 2A to 2D.

The gate circuits 10, 11, 12 of the counter section receive binary code signals representing a prescribed time of cooking which are delivered from the quantity-setting section through the terminals 10-1, 10-9, 10-10, 10-15, 11-1, 11-9, 11-10, 11-15 and 12-1, 12-10, 12-15. Thus the gate circuits 10, 11, 12 are set at values corresponding to the binary code signals. The decoder counters of the counter section are decimal up-down type designed to count down pulses from the counter 20 of the pulse-generating section, when the operation circuit 46 gives forth a signal instructing the commencement of cooking. For example, the up-down counter 10 is formed of four flip-flop circuits F21 to F24, NOR gate circuits G61 to G68, NAND/NOR gate circuits G71 to G77, AND gate circuits G81 to G91 and inverters I21 to I24 as shown in FIG. 11. The circuitry of FIG. 11 is also integrated. Other up-down counters 11, 12 have the same arrangement as that of FIG. 11. The numerals following the hyphens included in the referential notations given in FIG. 11 correspond to those of said other counters 11, 12. Referring to FIG. 11, 4-bit binary code signals for setting quantity of 0 to 9 grams which are supplied to the input terminals 10-1, 10-9, 10-10, 10-15 are conducted to one input terminal each of the NAND gates G71, G72, G73, G74. The other input terminal each of the NAND gates G71, G72, G73, G74 is supplied through an inverter I22 with a strobe signal delivered from the operation circuit 46. Outputs from the NAND gates G71 to G74, together with that from the inverter I22, are supplied to AND gates G85, G87, G89, G91, outputs from which are conducted to NOR gates G65, G66, G67, G68 together with clear signals delivered from the terminal 10-14 through an inverter I23. Outputs from the NAND gates G71 to G74 are transmitted to the Ps terminals of the flip-flop circuits F21 to F24. Outputs from the NOR gates G65 to G68 are supplied to the clear terminal C. The down-count terminal 10-4 and up-count terminal 10-5 are connected to the input terminal of the NOR gate G61 through the inverters I24, I21, and also to the input terminals of the AND gates G81, G82, G83, G84 and NAND/NOR gate G76 and those of the AND gates G86, G88, G90 and NAND/NOR gate G77. An out put from the NOR gate G61 is conducted to the Cp terminal of the flip-flop circuit F21, a Q output from which is supplied to the output terminal 10-3 of the up-down counter of FIG. 11, AND gates G81, G82, G83, G84 and NAND gate G76. A Q output from the flip-flop circuit F21 is transmitted to the input terminals of the AND gates G86, G88, G90 and NAND gate G77. A Q output from the flip-flop circuit F22 is supplied to the output terminal 10-2 of the up-down counter and the input terminals of the AND gates G82, G83, G84 and NAND gate G76. A $\overline{Q}$ output from the flip-flop circuit F22 is conducted to the AND gates G88, G90 and NAND gates G75, G77. A Q output from the flip-flop circuit F23 is transmitted to the output terminal 10-6 of the up-down counter and AND gate G83 and a Q output therefrom is supplied to the AND gate G90 and NAND gates G75, G77. A $\overline{Q}$ output from the flip-flop circuit F24 is delivered to the output terminal 10-7 of the up-down counter, and a $\overline{Q}$ output therefrom to the NAND gates G75, G77. An output from the NAND gate G75 is supplied to the AND gates G86, G88, outputs from which are delivered to the NOR gate G62. An output from the NOR gate G62 is transmitted to the Cp terminal of the flip-flop circuit F22. Outputs from the AND gates G82, G88 are conducted to the NOR gate G63, an output from which is supplied to the Cp terminal of the flip-flop circuit F23. Outputs from the AND gates G83, G84, together with an output from the AND gate G90, are transmitted to the NOR gate G64, an output from which is delivered to the Cp terminal of the flip-flop circuit F24. An output from the NAND gate G76 is conducted to the terminal 10-12 as a carry signal, and an output from the NAND gate G77 is supplied to the terminal 10-13 as a borrow signal.

The up-down counter 10 of the above-mentioned arrangement is operated as follows. Where the clear terminal 10-14 is impressed with a positive potential relative to the ground potential, namely, a logic signal "1", then the output terminals 10-2, 10-3, 10-6, 10-7 of the up-down counter 10 give forth a "0" signal. Where, under this condition, the strobe terminal 10-11 receives a "0" signal from the operation circuit 46, then the output terminals 10-2, 10-3, 10-6, 10-7 of the counter 10 give forth the same signal as that which is supplied to the input terminals 10-1, 10-9, 10-10, 10-15 of the up-down counter 10. Where a down-count signal sent from the terminal 20-11 of the counter 20 to the down-count terminal 10-4 is changed to (0) to (9), then the borrow terminal 10-13 generates an output, transmitting a borrow signal to the terminal 11-4 of the higher order counter 11. Conversely where an up-count signal delivered to the terminal 10-5 of the counter 10 is changed from (9) to (0), then the carry terminal 10-12 gives froth a carry signal to the terminal 11-51 of the higher order counter 11.

Figure 12:
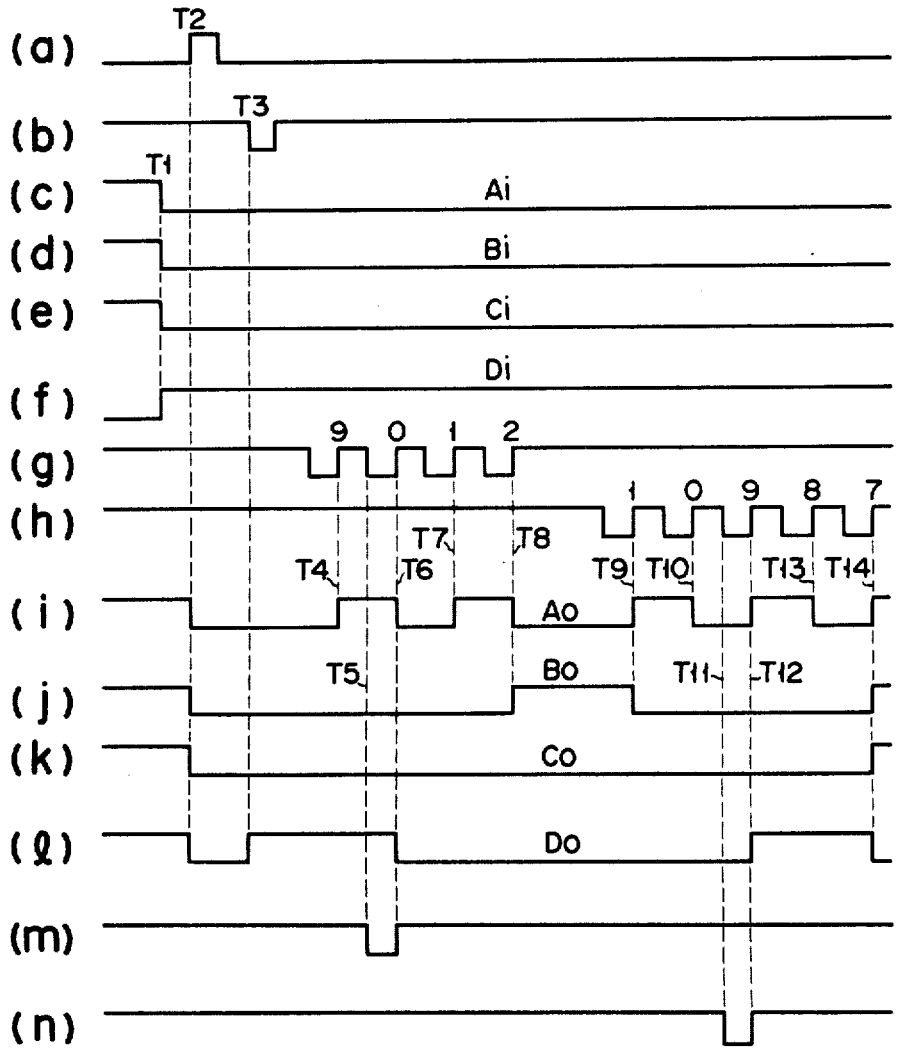
FIG. 12 indicates the wave forms of pulses by way of illustrating the operation of the counter of FIG. 11.

There will now be described by reference to FIG. 12 the operation of the up-down counter of FIG. 11. Now let it be assumed that input logical bit signals supplied to the terminals 10-15, 10-1, 10-10, 10-9 are designated as Ai, Bi, Ci, Di and outputs produced at the terminals 10-3, 10-2, 10-6, 10-7 as Ao, Bo, Co, Do. Further let it be supposed that at time T1 the inputs Ai to Di represent "0", "0", "0", "1" respectively as shown in FIG. 12*c* to FIG. 12*f* and the outputs Ao to Do all denote "1" as shown in FIG. 12*i* to FIG. 12*l*. Where, at the succeeding time T2, the terminal 16-14 is supplied with a clear pulse as shown in FIG. 12*a*, then the flip-flop circuits F21 to F24 are all cleared to change the outputs Ao to Do to "0". Where, under this condition, a strobe signal of "0" level as shown in FIG. 12*b* is supplied to the terminal 10-11, then the output Do has a logical level of "0" as indicated in FIG. 12*l* in response to the input Di of "1". Where under this condition, the terminal 10-5 is supplied with a count signal as shown in FIG. 12*g*, then the output Ao is brought to a level of "1" as shown in FIG. 12*i* at the rising time T4 of an up-count signal (9). At the falling time T5 of an up-count signal (0), the terminal 10-12 gives forth a carry signal as shown in FIG. 12*m*, and at the rising time T6 of the up-count signal (0). The output Ao is changed to "0" as indicated in FIG. 12*i* and also the output Do is brought to a level of "0" as shown in FIG. 12*l*, thus extinguishing the carry signal. Where an up-count signal (1) rises at time T7, then the output Ao is changed to "1". Where an up-count signal (2) rises at time T8, then the output Ao has a level of "0" and the output Bo is changed to "1". Thus, counts represented by 4-bit binary code outputs progressively increase. Where, at the succeeding time T9, a down-count signal (1) of FIG. 12*h* rise at the terminal 10-4, then the output Ao is changed to "1" and the output Bo to "0". Where a down-count signal (0) rises at time T10, then all the outputs Ao to Do are brought to a level of "1". Thus at time T11, a down-count signal (9) falls and in consequence a borrow signal is produced from the terminal 10-13. Further, the down-count signal (9) rises at time T12, and the outputs Ao and Do are changed into "0" to extinguish the borrow signal. Where a down-count signal (8) rises at time T13, then the output Ao has a level of "0". Where a down-count signal (7) rises at the succeeding time T14, then the outputs Ao, Bo and Co are changed to "1" and the output Do to "0". A down-count operation proceeds in the abovementioned manner.

Counts (including zero) made by the counters 10, 11, 12 are delivered to the circuits 31, 32, 33 of the display section of FIG. 2A for decoding to effect binary code-decimal conversion and driving a display device (hereinafter simply referred to as "a decoder/driver circuit") in the form of 4-bit signals coded with a weight of 1–2–4–8. Binary code signals supplied to the terminals 31-1, 31-2, 31-6, 31-7; 32-1, 32-2, 32-6, 32-7; and 33-1, 33-2, 33-6, 33-7 of the decoder/driver circuits 31, 32, 33 respectively are decoded into decimal signals, followed by amplification, and then delivered to digital display devices 34, 35, 36 through the corresponding terminals 31-9 to 31-15; 32-9 to 32-15; and 33-9 to 33-15. The decoder/driver circuit 31 comprises, as shown in FIG. 13, NAND/NOR gate circuits G110 to G117, AND gates G118 to G141, inverter cicuits I31 to I39 and amplifiers A11 to A13 all assembled in an integrated form.

Figure 13:
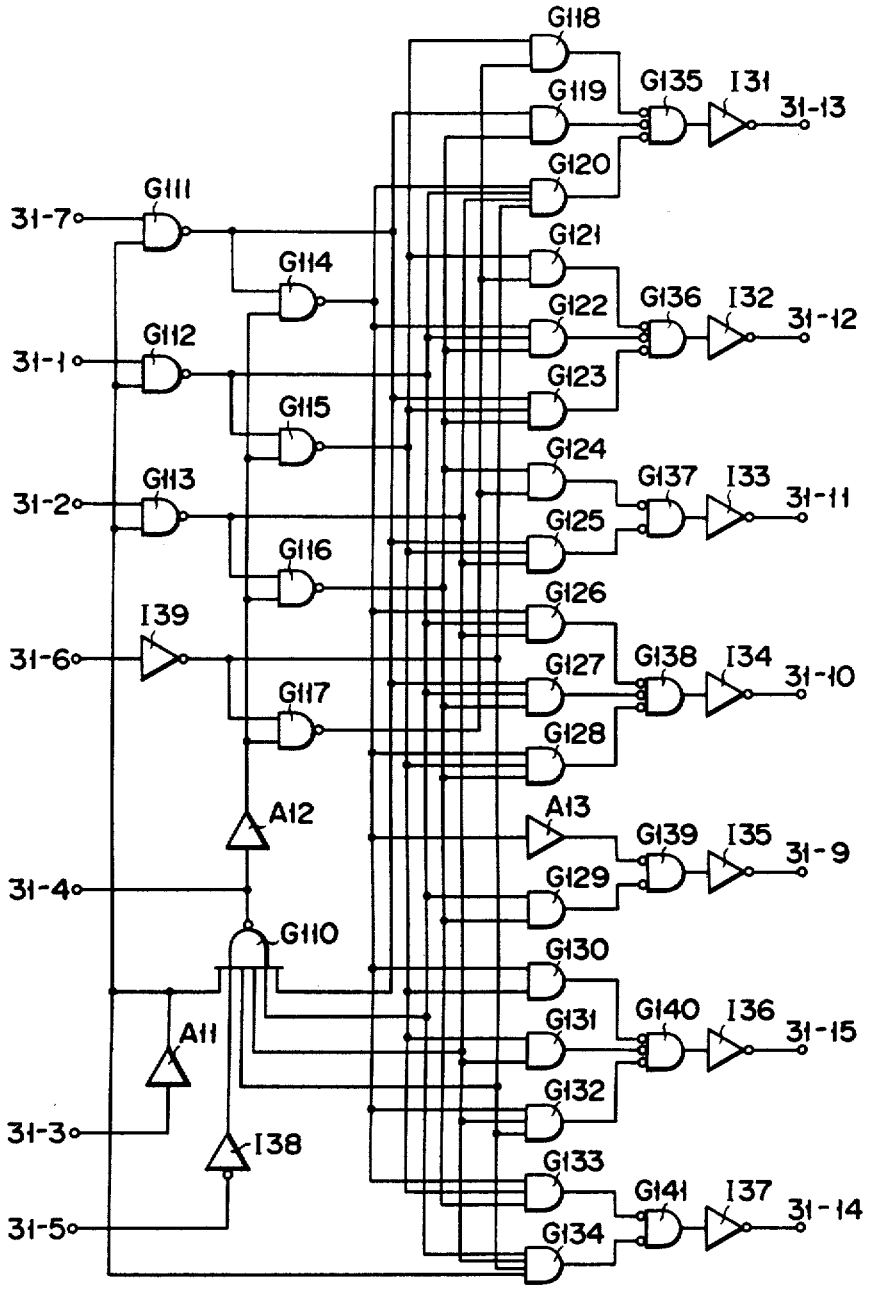
FIG. 13 shows a concrete arrangement of a gate circuit of FIG. 2A for making binary code-decimal numeral conversion.

Referring to FIG. 13, the inputs Ai, Bi, Ci, Di supplied to the terminals 31-7, 31-1 31-2, 31-6 are transmitted to one input terminal each of the NAND gates G111, G112, G113 and also to the inverter I39. The other input terminals of the NAND gates G111, G112, G113 are supplied with a lamp test signal from the terminal 31-3 through the amplifier A11. Outputs from the NAND gates G111 to G113 and inverter I39 are supplied to one input terminal each of the NAND gates G114 to G117 and also to the selected ones of the AND gates G118 to G134. The other input terminals of the NAND gates G114 to G117 are supplied with a blanking input from the terminal 31-4 and an output from the NAND gate G110. The input terminal of the NAND gate G110 is supplied with an output from each of the amplifier A11, inverters 138, 139, and NAND gates G111 to G113. Outputs from the NAND gates G114 to G117 are supplied to the selected ones of the AND gates G118 to G134 and also to the amplifier A13. Outputs from the AND gates G118 to G120 are supplied to the AND gate G135; outputs from the AND gates G121 to G123 to the AND gate G135; outputs from the AND gates G124, G125 to the AND gate G137; outputs from the AND gates G126 to G128 to the AND gate G138; outputs from the amplifier A13 and an output from the AND gate G129 to the AND gate G139; outputs from the AND gates G130 to G132 to the AND gate G140; and outputs from the AND gates G133, 134 to the AND gate G141. The input terminals of all the AND gates G135 to G141 are provided with the corresponding inverters as shown in FIG. 13. Outputs from the AND gates G135 to G141 are conducted to the output terminals 31-13, 31-12, 31-11, 31-10, 31-9, 31-15 and 31-14 through the corresponding inverters 131 to 137. The other decoder-driver circuits 32, 33 have the same arrangement as the decoder/driver circuit 31.

Figure 14:
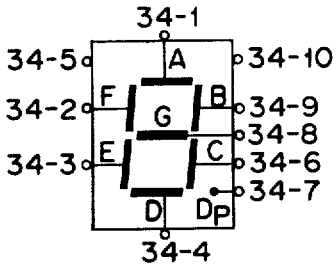
FIG. 14 indicates an arrangement of the display device of FIG. 2A.
Figure 15:
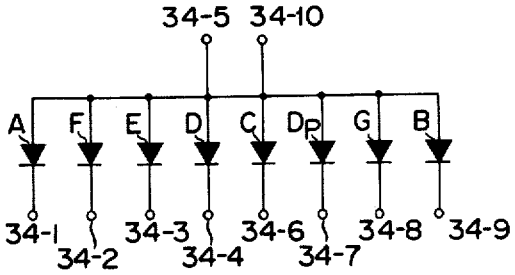
FIG. 15 is a circuit diagram of the display device of FIG. 14 consisting of light-emitting diodes.

Binary code signals converted into decimal numerals by the decoder/driver circuits 31, 32, 33 are transmitted to the corresponding input terminals of the display devices 34, 35, 36 from three groups of seven terminals as 31-9 to 31-15; 32-9 to 32-15; and 33-9 to 33-15 through the corresponding resistors R. The display device 34 consists of eight display segments A, B, C, D, E, F, G, $D_p$ as illustrated in FIG. 14. These display segments A to $D_p$ are connected, as shown in FIG. 14, to the input terminals 34-1, 34-9, 34-6, 34-4, 34-3, 34-2, 34-8, 34-7. The display segments A to $D_p$ are formed of, for example, light-emitting diodes, and are impressed with voltages selectively across the anodes connected to the terminals 34-5 and 34-10 and the cathodes connected to the terminals 1-4 and 6-9 for illumination display. The display device 34 has a circuit arrangement as shown in FIG. 15. A numeral 3, for example, is indicated by the illumination of the display segments A, B, G, C, D. The display segment $D_p$ denotes a decimal point, and, in the embodiment of FIG. 1A, only the terminal 35-7 of the display device 35 is impressed with voltage.

Outputs from the up-down counters 10, 11, 12 are further supplied to the gate circuits 40, 41 of the detection section. This detection section detects the counts made by the counters 10, 11, 12, and when said counts reach a prescribed value, namely, a preset gram, sends forth its own output to the operation circuit 46. The detection section consists of gate circuits 40, 41, 42, 43, inverters 44, 45 and a capacitor C4. The gate circuits 40, 41 may each be formed of the integrated circuit of FIG. 7; the gate circuit 42 of the integrated circuit of FIG. 6; the gate circuit 43 of the integrated circuit of FIG. 4; and the inverters 44, 45 of the integrated circuit of FIG. 10. The numerals following the hyphens included on the referential notations of the terminals of these circuits correspond to the referential numerals of the terminals of the respective integrated circuits.

An output from the detection section is supplied through the capacitor C4 to the operation circuit 46 of the electronic range-controlling section.

This electronic range-controlling section is connected to an A.C. source 47 and comprises a power supply switch 48; bidirectional thyristor 49; an NPN transistor 50 for controlling the ON-OFF state of the thyristor 49; an inverter 51 and gate circuit 27 for rendering the transistor 50 operative or inoperative according to a signal from the operation circuit 46; an electromagnetic switch 52 energized in response to the operation of the thyristor 49; the main contacts 52-1, 52-2 of the electromagnetic switch 52; a high frequency generator 53 having power supply thereto controlled by the main contacts 52-1, 52-2; a DC control power source 54; and the operation circuit 46. The inverter 51 may be formed of the integrated circuit of FIG. 10 and the gate circuit 27 of the integrated circuit of FIG. 4. The high frequency generator 53 provided in the body R shown in FIG. 1 is intended to emit high frequency electromagnetic wave into the heating chamber of the electronic range, and consists of a high voltage transformer 55, heater transformer 56, rectifier circuit 57 and magnetron 58. The DC control power circuit 54 is designed to supply direct current to all other circuits than that associated with the high frequency generator 53, and consists of a transformer 59, rectifier circuit 60 and constant voltage diode 61. The operation circuit 46 is mainly formed of a start switch 62 for commencement of cooking or heating, a stop switch 63 for stoppage of cooking or heating, reset switch 64, semiconductor-controlled rectifier elements (abbreviated as SCR) 65, 66 and diodes 67, 68. The start and stop switches 62, 63 and reset switch 64 are of normally closed push-button type as shown in FIG. 1. The cooking stop switch 63 may be so designed as to be rendered inoperative and operative, for example, in interlocking relationship with the opening and closure of the door of the heating chamber.

Thee will now be described the operation of the embodiment of FIGS. 2A to 2D. Throughout the following description, a "0" signal is the one denoting the ground potential, and a "1" signal is the one showing positive potential relative to the ground potential, namely, output voltage +V (for example, 5 volts) from the DC control power source 54.

When the power supply switch 48 is thrown in, an output voltage from the power source 54 rises to a level of +V (about 5 volts). At this time, a transient signal flows through a resistor R4, capacitor C5 and resistor R5 to charge the capacitor C5. Voltage impressed across both ends of the resistor R5 by the charge current is supplied to the gate of the SCR 66. Thus the SCR 66 is rendered operative to have its anode side voltage level brought to that of "0". As the result, the terminal 27-10 of the gate circuit 27 connected to the anode of the SCR 66 and the terminals 10-11, 11-11, 12-11 of the up-down counters 10, 11, 12 respectively present a "0" voltage level. Outputs *c*, *d*, *e* from the up-down counters 10, 11, 12 have the same level as seen from the timing chart of FIG. 12, as input signals, namely, output signals *f*, *g*, *h* from the quantity-setting section. The above-mentioned output signals *c*, *d*, *e* are supplied to the display devices 34, 35, 36 through the decoder/driver circuits 31, 32, 33 so as to display set time in the form of decimal numerals. Since, at this time, an input signal to the input terminal 27-10 of the gate circuit 27 has a logical level of "0", one input terminal of the NAND gate G13 of FIG. 4 also has a logical level of "0", causing the output terminal 27-8 to give forth a "1" output, and in consequence the output terminal 51-8 of the inverter 51 to produce a "0" output. This "0" output renders the NPN transistor 50 in the OFF state and in consequence the bidirectional thyristor 49 inoperative. As the result, the electromagnetic switch 52 is deenergized and the high frequency generator 53 is also put out of operation.

Under this condition, input signals to the strobe terminals 10-11, 11-11, 12-11 of the counters 10, 11, 12 all have a level of "0". When, therefore, the weight of food being cooked is entered in the quantity-setting section by operating the quantity-setting switches S1, S2, S3, the weight thus entered is supplied to the display devices 34, 35, 36 through the counters 10, 11, 12 and decoder driver circuits 31, 32, 33 to be indicated on said display devices 34, 35, 36. Where the weight of food amounts to, for example, 150 grams, a numerical value of 150 is entered in the counters 10, 11, 12 through the closure of the contact 0 of the switch S1, the contact 5 of the switch S2 and the contact 1 of the switch S3 to be displayed as shown in FIG. 1. Namely, binary signals weighted with a code of 1–2–4–8 which correspond to the digits (0), (5) and (1) are set in the counters 10, 11, 12 respectively. The counts made by the counters 10, 11, 12 are delivered in a state weighted with a code of 1–2–4–8 to the decoder driver circuits 31, 32, 33 where binary signal-decimal numeral decoding or conversion is carried out. A decimal numeral obtained by said decoding is conducted from the decoder/driver circuits 31, 32, 33 to the display devices 34, 35, 36.

When the weight of food being cooked is fully set in the setting section, any of the push-button switches SW1, SW2 . . . . . SWN of FIG. 1 is depressed according to the kind of the food. If the food is, for example, fish, the push-button switch SW1 is operated. As a result, the switch SW of FIG. 2D is connected to one terminal of the variable resistor VR1 and the oscillation time constant of the pulse generator 17 is defined by said variable resistor VR1 and capacitor C1. Therefore, the pulse generator 17 gives forth pulse signals with an optimum period for the cooking of fish. This period is determined from the time required to heat one gram of fish to a necessary level of temperature.

As mentioned above, the weight and kind of food being cooked are visibly set on the operation panel OP. Namely, a necessary time of thermal cooking is automatically set by the electronic digital timer of an electronic range.

On the other hand, the gate circuit 27 generates an output of "1" and accordingly the inverter 25 produces an output of "0". Since the input terminals 24-5, 24-6 of the gate circuit 24 have a logical level of "0", the output terminal of the NOR gate 42 of FIG. 7, namely, the output terminal 24-4 of the gate circuit 24 gives forth "1" output, thus rendering the transistor 21 operative and the light-emitting diode 29 extinguished. Under this condition, pulses being supplied to the input terminal 20-14 of the counter 20 included in the pulse-generating section are already grounded. Therefore, the output terminal 20-11 of the pulse-generating section does not send forth any pulse to the input terminal of the up-down counter 10. Though, under the above-mentioned conditions, the display devices 34, 35, 36 indicate different categories of weight already set by the weight-setting switches S1, S2, S3, no time counting is carried out, nor is applied any heating.

When the cooking start switch 62 is closed after the weight and kind of the food are set, then both ends of the SCR's 65, 66 respectively are forcefully short-circuited in a moment, if an output from the detection section, namely, an input to the gate of the SCR 66 has a level of "0", thereby turning off the SCR's 65, 66. As the result, the anode of the SCR 66 has a logical level of "1", the transistor 50 is put into operation, and the transistor 21 is rendered inoperative. When the transistor 50 is thus put into operation, the thyristor 49 is triggered for operation to energize the electromagnetic switch 32. Accordingly, the main contacts 52-1, 52-2 of the switch 52 are closed to actuate the high frequency generator 53, for the thermal cooking of the fish placed in the heating chamber of the body R shown in FIG. 1 of the electronic range. Since, at this time, the transistor 21 is turned off, the pulse-generating section sends forth pulses to the counter 20, where the number of pulses supplied thereto is counted down. Thus, the counts previously stored in the counters 10, 11, 12 downwardly vary with the count condition within the counter 20. The display devices 34, 35, 36 indicate the downward variations of counts in the counters 10, 11, 12. Namely, the indication of the devices 34, 35, 36 varies as 150-149-148 . . . . . At this time, the light-emitting diode 29 is supplied with pulses from the monostable multivibrator 22 of the pulse-generating section in response to the inoperative condition of the transistor 21. The light-emitting diode 29 is energized and extinguished per pulse period. This intermittent actuation of the light-emitting diode 29 shows that the high frequency generator 53 is in operation.

Where the cooking stop switch 63 is closed during the operation of the high frequency generator 53, then the gate of the SCR 65 is supplied with a "1" signal and becomes operative. Accordingly, the input terminal 27-9 of the gate circuit 27 is supplied with a "0" signal, and the gate circuit 27 generates a "1" output and in consequence the inverter 51 produces a "0" output, causing the transistor 50 to be turned off and the transistor 21 to be turned on. The thyristor 49 is put out of operation to stop the high frequency generator 53. Also, the transistor 21 is operated to extinguish the lights emitting diode 29 and stop the supply of pulses to the counter 20. Since, at this time, the SCR 66 remains inoperative with its anode kept at a logical level of "1", the counters 10, 11, 12 hold the counts which they made at the closure of the cooking stop switch 63, and the display devices 34, 35, 36 make indications corresponding to the counts held by the counters 10, 11, 12.

Where the reset switch 64 is closed during the operation of the high frequency generator 53 or after the closure of the cooking stop switch 63, then the SCR 66 becomes operative with its potential changed to a level of "0", causing the transistor 50 to be turned off and the transistor 21 to be turned on. As the result, heating of the foods and the operation of the timer are brought to an end. Since the logical level of the anode of the SCR 66 is changed to "0", the outputs *c, d, e* from the counters 10, 11, 12 have the same logical level as the input signals *f, g, h.* As the result, indications on the display devices 34, 35, 36 are brought back to those representing the weight (150g) originally set at the commencement of heating.

Where the preset time of cooking has passed after the closure of the cooking start switch 62, then the counter 20 is subjected to down counting, and the counts previously made thereby are brought to (0). At this time, the outputs *c, d, e* from the counters 10, 11, 12 all have a logical level of "0", showing that the counts made by these counters 10, 11, 12 coincide with a prescribed length of time. As the result, the gate circuits 40, 41 of the time detection section are all supplied with an input of "0". Namely, the NOR gates G41, G42, G43, G44 of FIG. 7 are all supplied with an input of "0". Therefore, the gate circuits 40, 41 generate a "1" output, which is supplied to the gate circuit 42. Since all the input terminals of FIG. 6 are made to have a logical level of "1", the NAND gates G31, G32, G33 produce an output of "0", and in consequence the inverter 44 gives forth an output of "1". This "1" output is supplied to the two input terminals 43-1, 43-2 of the gate circuit 43. Since the input signals to the gate G11 of FIG. 4 have a logical level of "1", the output terminal 43-3 of the gate circuit 43 produces a "0" signal, and in consequence the inverter 45 generates a "1" output. This "1" output is supplied to the gate electrode of the SCR 66 through the capacitor C4 to render the SCR 66 operative. Since the anode potential of the SCR 66 has a level of "0", the high frequency generator 53 is stopped, the light-emitting diode 29 is extinguished and the counter 20 ceases to be supplied with pulses. Thus, the display devices 34, 35, 36 make the same indications as those representing the initially set weight (150g). Thus, upon lapse of the preset time, thermal cooking is brought to an end.

While the weight-setting section sets weight at (0), then the contacts S10, S20, S30 of the time-setting switches S1, S2, S3 remain closed. At this time, all the input signals to the gate circuit 9 have a logical level of "0". Namely, the gates G43, G44 of FIG. 7 are all supplied with a "0" input and generate a "1" output. Since two input signals to the gate circuit 13 have a logical level of "1", the gate circuit G12 of FIG. 4 is supplied with two "1" input signals and produces a "0" output. Accordingly, the gate circuit 14 is supplied with a "0" input, and in consequence the NAND gate G14 of FIG. 4 is supplied with two "0" input signals and gives forth a "1" output. This "1" output is conducted to the gate electrode of the SCR 66 through the diode D4 to actuate the SCR 66, which remains thus energized, preventing heating of the foods and the operation of the timer and causing all the display devices 34, 35, 36 to continue to make the (0) indication.

In the embodiment of FIGS. 2A to 2D the weight-setting switches S1, S2, S3 may consist of any of a push-button switch, snap switch, rotary switch, keyboard switch, etc. Further, the pulse generation circuit may be formed of an astable multivibrator. It is also possible to use the thyristor 49 directly in turning on or off the power source of the high frequency generation circuit, instead of energizing or deenergizing the electromagnetic switch 52 according to the ON or OFF condition of the thyristor 49. The thyristor 49 need not be limited to a bidirectional type but may be formed of an SCR. Further, the up-down counters 10, 11, 12 may act simply as up-counters in place of down-counters. In this case, it is advised to provide in the detection section a coincidence circuit which compares outputs from the weight-setting section and those from the counters 10, 11, 12 and generates its own output, in case coincidence takes place between the two groups of outputs.

The foregoing embodiment includes a large number of integrated circuits. If these circuits are further integrated, it will be possible to provide an electronic range whose timer section is made very compact.

As mentioned above, this invention enables a desired time of thermally cooking food to be automatically determined by setting the kind of food through the switches SW1, Sw2 . . . . . SWN provided on the operation panel OP and also setting a value representing the separately measured quantity of food by the switches S1, S2, S3 similarly provided on said operation panel OP, the result of setting being visibly indicated by the display devices 34, 35, 36 also fitted to said panel OP. Therefore, the electronic range of this invention eliminates the troublesome work of selecting the time of cooking food by separately searching for an optimum length of time or from the experience or sense of persons using an electronic range at each time of cooking, as has generally been the case in the past.

Accordingly, the present electronic range can easily cook food in heating time properly set for its quantity and kind. Said electronic range using an electronic digital timer is little subject to failure, elevating a safety factor and displaying excellent properties with respect to errors and precision of cooking time. Moreover with the electronic range of this invention, the kind of food being cooked can be easily found simply by a look at the depressed one of the various switches SW1 to SWN provided on the operation panel OP. Also a lapse of time since the commencement of heating can be readily recognized even afar by observing the progressively decreasing decimal numeral indicated on the display devices 34, 35, 36 also fitted to the operation panel OP. Therefore, the electronic range of this invention eliminates the erroneous observation of the timer needle and other drawbacks accompanying the prior art electronic range.

The foregoing description refers to the case where a value representing the separately measured quantity of food being cooked was manually set by the food-quantity setting switches S1, S2, S3. However, this invention is not limited to said embodiment, but may be practised by providing an electronic food-quantity-measuring scale on the floor of the heating chamber of an electronic range and automatically setting the counters 10, 11, 12 and display devices 34, 35, 36 according to the measured quantity of food placed in the heating chamber.

What we claim is:

1. An electronic range provided with a high frequency generator, which comprises a device including quantity-setting switches for setting a value representing the quantity of food being cooked; a device for indicating the set value in the form of digits; a pulse generator having a time constant circuit; a device including kind-setting switching means for varying the time constant of the time constant circuit to vary the period between pulses generated by said pulse generator in accordance with the kind of food; a counter for counting the number of pulses generated from said pulse generator upon the commencement of heating; and a control device for bringing the operation of the high frequency generator to an end when a prescribed relationship arises between the counts made by the counter and the set value set by said value setting device.

2. An electronic range according to claim 1 wherein the device for setting a value representing the quantity of food being cooked includes a decimal numeral-binary code conversion circuit for converting a decimal numeral denoting the quantity of said food into a binary code signal.

3. An electronic range according to claim 1 wherein the device for varying the period between pulses generated by the pulse generator comprises a plurality of time constant elements and a changeover switch for connecting the selected one of said timne constant elements to the pulse generator.

4. An electronic range according to claim 3 wherein said time constant elements are variable resistors.

5. An electronic range according to claim 1 wherein the counter for counting the number of pulses generated from the pulse generator upon the commencement of heating comprises at least one counter in which a decimal numeral previously set by the food-quantity setting device according to the quantity of food being cooked is set in the form of binary code signals and which counts down by counting pulses generated by the pulse generator upon commencement of heating by the electronic range; the control device further comprising a detection circuit, a switch rendered inoperative when said detection circuit generates an output and a device for cutting off the power supply to the high frequency generator of the electronic range when said switch is rendered inoperative.

6. An electronic range according to claim 5 wherein the control device comprises a gate circuit for producing an output when a value previously set by the food-quantity setting device is counted down to zero; a reset switch; a first SCR whose gate electrode is supplied with a selected one of outputs from said reset switch, said detection circuit and said gate circuit; a cooking stop switch; a second SCR whose gate electrode is supplied with an output from the cooking stop switch; a cooking start switch; a device for forcefully deenergizing the first and the second SCR upon the closure of the cooking start switch; a transistor rendered operative upon the actuation of said first SCR: a thyristor energized upon the operation of said transistor; an electromagnetic switch excited upon the energization of said thyristor; and a device for operating the power supply circuit of the electronic range upon the actuation of said electromagnet switch.

7. An electronic range according to claim 1 which further comprises a light-emitting display device actuated by pulses delivered from the pulse generator to the counting device upon commencement of a food-heating operation to indicate the time necessary to complete the food-heating operation.

8. An electronic range according to claim 1 wherein the digital display device includes a plurality of display segments each consisting of a light-emitting diode.

* * * * *